US005785500A

United States Patent [19]

Leniek

[11] Patent Number: 5,785,500

[45] Date of Patent: Jul. 28, 1998

[54] WELL PUMP HAVING A PLUNGER IN CONTACT WITH WELL AND PUMP FLUID

[75] Inventor: Humberto F. Leniek, Houston, Tex.

[73] Assignee: Quality Tubing, Inc., Houston, Tex.

[21] Appl. No.: 643,055

[22] Filed: May 2, 1996

[51] Int. Cl.[6] ..... F04B 49/00; F04B 47/12

[52] U.S. Cl. ..... 417/46; 417/56; 417/58

[58] Field of Search ..... 417/46, 377, 390, 417/401, 56, 58; 166/321, 106

[56] References Cited

U.S. PATENT DOCUMENTS

| | | | |
|---|---|---|---|
| 1,765,457 | 6/1930 | Shutt . | |
| 2,253,780 | 8/1941 | Gurley . | |
| 3,517,741 | 6/1970 | Roeder . | |
| 3,625,288 | 12/1971 | Roeder . | |
| 3,703,926 | 11/1972 | Roeder . | |
| 4,421,463 | 12/1983 | Lee . | |
| 4,492,536 | 1/1985 | Gilbertson | 417/401 |
| 4,565,496 | 1/1986 | Soderberg | 417/46 |
| 4,611,974 | 9/1986 | Holland | 417/388 |
| 4,664,186 | 5/1987 | Roeder . | |
| 4,666,375 | 5/1987 | Kime | 417/46 |
| 4,738,599 | 4/1988 | Shilling | 417/400 |
| 4,768,589 | 9/1988 | Roeder . | |
| 5,104,296 | 4/1992 | Roeder . | |
| 5,456,318 | 10/1995 | Priestly | 166/369 |

*Primary Examiner*—Ayaz R. Sheikh
*Assistant Examiner*—Xuan M. Thai
*Attorney, Agent, or Firm*—Fish & Richardson, PC

[57] ABSTRACT

A pump apparatus for use in a pump system of a well capable of exerting and releasing pressure on a pump fluid supplied to the pump apparatus. The pump apparatus includes a tubular body having a pump fluid space for communicating with the pump fluid and a chamber for receiving unpumped well fluid and for furnishing pumped well fluid to a wellhead of the well, wherein the pump fluid and the pumped well fluid remain separated. The pump apparatus includes a device located inside the tubular body and in contact with the pump fluid space for displacing the pumped well fluid from the chamber to the wellhead in response to the pump system exerting pressure on the pump fluid and for receiving the unpumped well fluid from a producing formation and delivering the unpumped well fluid to the chamber in response to the pump system releasing pressure on the pump fluid.

14 Claims, 8 Drawing Sheets

WELL PUMP HAVING A PLUNGER IN CONTACT WITH WELL AND PUMP FLUID

BACKGROUND

The invention relates to a well pump.

As shown in FIG. 1, a typical subterranean oil well 400 uses a surface beam pumping unit 402 to actuate a down hole pump 404 located near a producing formation 406 siphoned by the well 400. Sucker rods 408 extend from the beam pumping unit 402 to the down hole pump 404 and are used to drive the down hole pump 404. The required cross-sectional diameter of a production tubing 410 used for carrying the oil to the surface is governed by the production capacity of the well 400 and the size of the sucker rods 408.

SUMMARY

In general, in one aspect, the invention features a pump apparatus for use in a pump system of a well capable of exerting and releasing pressure on a pump fluid supplied to the pump apparatus. The pump apparatus has a tubular body having a pump fluid space for communicating with the pump fluid and a chamber for receiving unpumped well fluid and for furnishing pumped well fluid to a wellhead of the well, wherein the pump fluid and the pumped well fluid remain separated.

The pump apparatus also has a device located inside the tubular body and in contact with the pump fluid space for displacing the pumped well fluid from the chamber to the wellhead in response to the pump system exerting pressure on the pump fluid and for receiving the unpumped well fluid from a producing formation and delivering the unpumped well fluid to the chamber in response to the pump system releasing pressure on the pump fluid.

Implementation of the invention may include one or more of the following features. The tubular body may include an orifice for establishing fluid communication between the pump fluid space and the pump fluid. The device may include a tubular body for receiving the well fluid from the producing formation and a valve located inside the tubular body of the device for allowing well fluid communication between the producing formation and the chamber in response to the pump system releasing pressure on the pump fluid and inhibiting well fluid communication between the producing formation and the chamber in response to the pump system exerting pressure on the pump fluid.

The device may be a plunger and the weight of the unpumped well fluid in the chamber moves the plunger back to a non-displaced position allowing the unpumped well fluid to enter the chamber in response to the pump system releasing pressure on the pump fluid. The pump apparatus may also have a valve located inside the tubular body for allowing the unpumped well fluid to enter the tubular body from the producing formation when the pump system exerts pressure on the pump fluid and inhibiting the unpumped well fluid from leaving the tubular body and flowing back to the producing formation when the pump system releases pressure on the pump fluid.

The tubular body may include an orifice for establishing fluid communication between the pump fluid and the pump fluid space and the pump apparatus may also have a tubular body, circumscribing the tubular body housing the device, for storing the pump fluid. The device may be a plunger and the weight of the plunger moves the plunger back to a non-displaced position allowing the unpumped well fluid to enter the chamber in response to the pump system releasing pressure on the pump fluid.

In general, in another aspect, the invention features a pump system of a well having a pump reservoir for storing pump fluid and a pump for exerting and releasing pressure on the pump fluid. The pump system has a control unit for controlling the pump, wherein the control unit instructs the pump to exert pressure on the pump fluid and subsequently instructs the pump to release pressure on the pump fluid after a predefined volume is displaced by the pump system. The pump system has a tubular body having a pump fluid space for communicating with the pump fluid and a chamber for receiving unpumped well fluid and for furnishing pumped well fluid to a wellhead of the well, wherein the pump fluid and the pumped well fluid remain separated.

The pump system has a device located inside the tubular body and in contact with the pump fluid space for displacing the pumped well fluid from the chamber to the wellhead in response to the pump system exerting pressure on the pump fluid and for receiving the unpumped well fluid from a producing formation and delivering the unpumped well fluid to the chamber in response to the pump system releasing pressure on the pump fluid.

Implementation of the invention may include one or more of the following features. The control unit may monitor the pressure exerted on the pump fluid by the pump, and the control unit determines the predefined volume is displaced when a predetermined pressure is exerted on the pump fluid by the pump system.

In general, in another aspect, the invention features a method for pumping well fluid from a well by selectively applying or releasing pressure on pump fluid supplied to a pump apparatus having a chamber. The method has the steps of releasing pressure on the pump fluid and transferring unpumped well fluid from a producing formation of the well into the chamber in response to the step of releasing pressure on the pump fluid. The method has the steps of exerting pressure on the pump fluid and displacing pumped well fluid from the chamber to a wellhead of the well in response to the step of exerting pressure on the pump fluid, wherein the pump fluid and the pumped well fluid remain separated.

Implementation of the invention may include one or more of the following features. The step of transferring may include moving a plunger using the weight of unpumped well fluid in the chamber. The step of transferring may include moving a plunger using the weight of the plunger. The method may further have a step of removing the pumped well fluid before the pressure on the pump fluid is released.

In general, in another aspect, the invention features a method for renovating a subterranean well. The method has the steps of removing a down hole pump from the well, seating a pump apparatus inside an outer tubing of the well and forming a seal between an outer surface of the pump apparatus and an interior surface of the outer tubing such that a reservoir space is formed for a pump fluid used by the pump apparatus.

Implementation of the invention may include one or more of the following features. The method may have the step of removing sucker rods of the subterranean well. The method may have the step of filling the reservoir space with the pump fluid. The method may have the step of installing a hydraulic pump for exerting pressure on the pump fluid. The outer tubing may be a casing of the well and the step of forming a seal includes inserting packing element between the outer surface of the pump apparatus and the inner surface of the casing. The outer tubing may be a cylindrical tubing located between a casing of the well and the outer surface of the pump apparatus.

In general, in another aspect, the invention features a pump apparatus for use in a pump system of a well capable of exerting and releasing pressure on a pump fluid supplied to the pump apparatus. The pump apparatus has a tubular body having a pump fluid space and orifices for establishing fluid communication between the pump fluid and the pump fluid space and a chamber for receiving unpumped well fluid and for furnishing pumped well fluid to a wellhead of the well, wherein the pump fluid and the pumped well fluid remain separated. The pump apparatus has a reciprocating tubular plunger located inside the tubular body and in contact with the pump fluid space having a valve which closes for displacing the pumped well fluid from the chamber to the wellhead in response to the pump system exerting pressure on the pump fluid and opens for receiving the unpumped well fluid from a producing formation and delivering the unpumped well fluid to the chamber in response to the pump system releasing pressure on the pump fluid, wherein the plunger moves back to a non-displaced position under the weight of the unpumped well fluid when the pump system releases pressure on the pump fluid.

Among the advantages of the invention are one or more of the following. The pump apparatus can be placed in a well having a small cross-sectional diameter. No sucker rods are required. No beam pumping unit is needed.

Other advantages and features will become apparent from the following description and from the claims.

DESCRIPTION OF THE PREFERRED EMBODIMENTS

Figure 1:
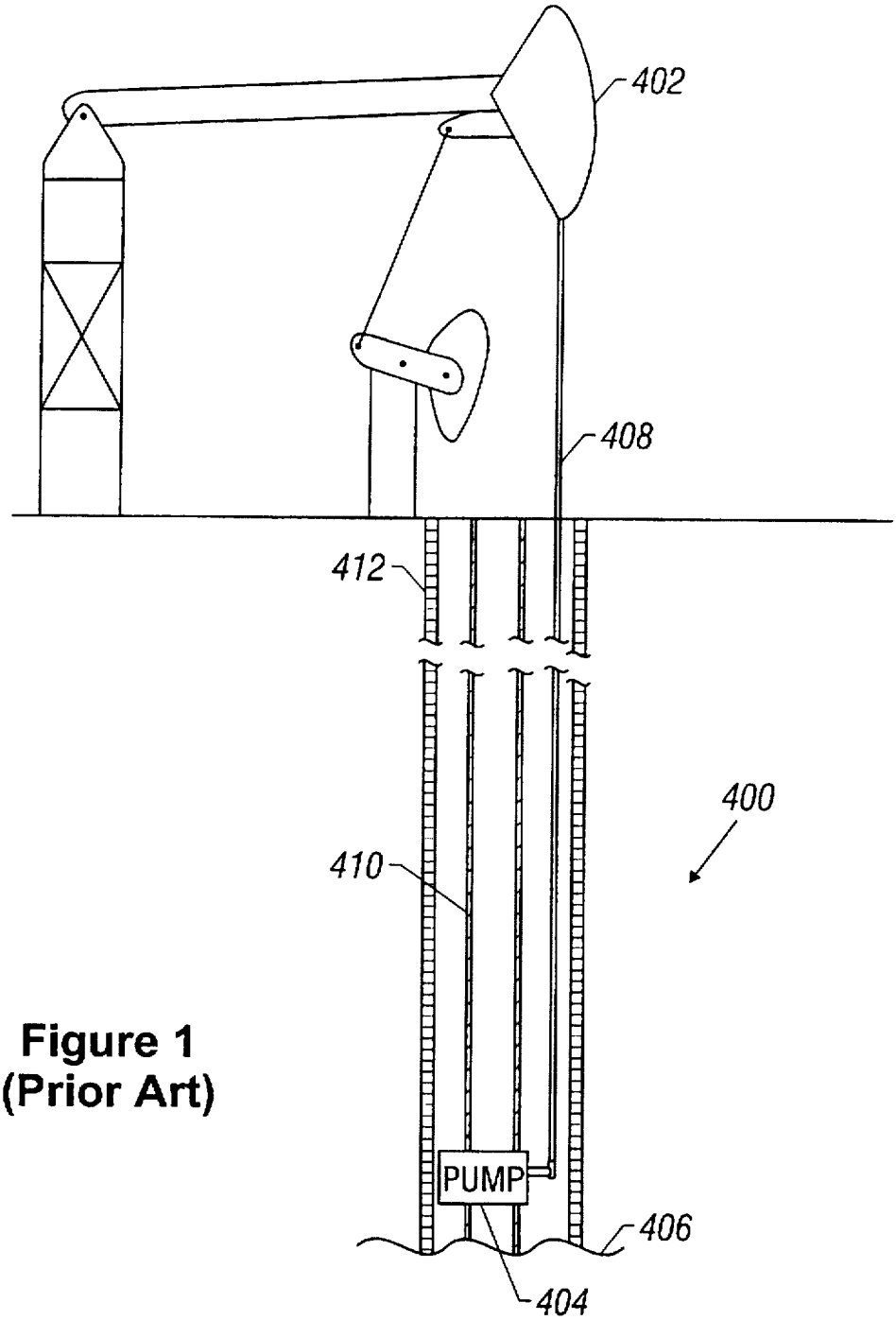
Figure 1 (Prior Art)
FIG. 1 is a cross-sectional side view of a subterranean well.
Figure 2:
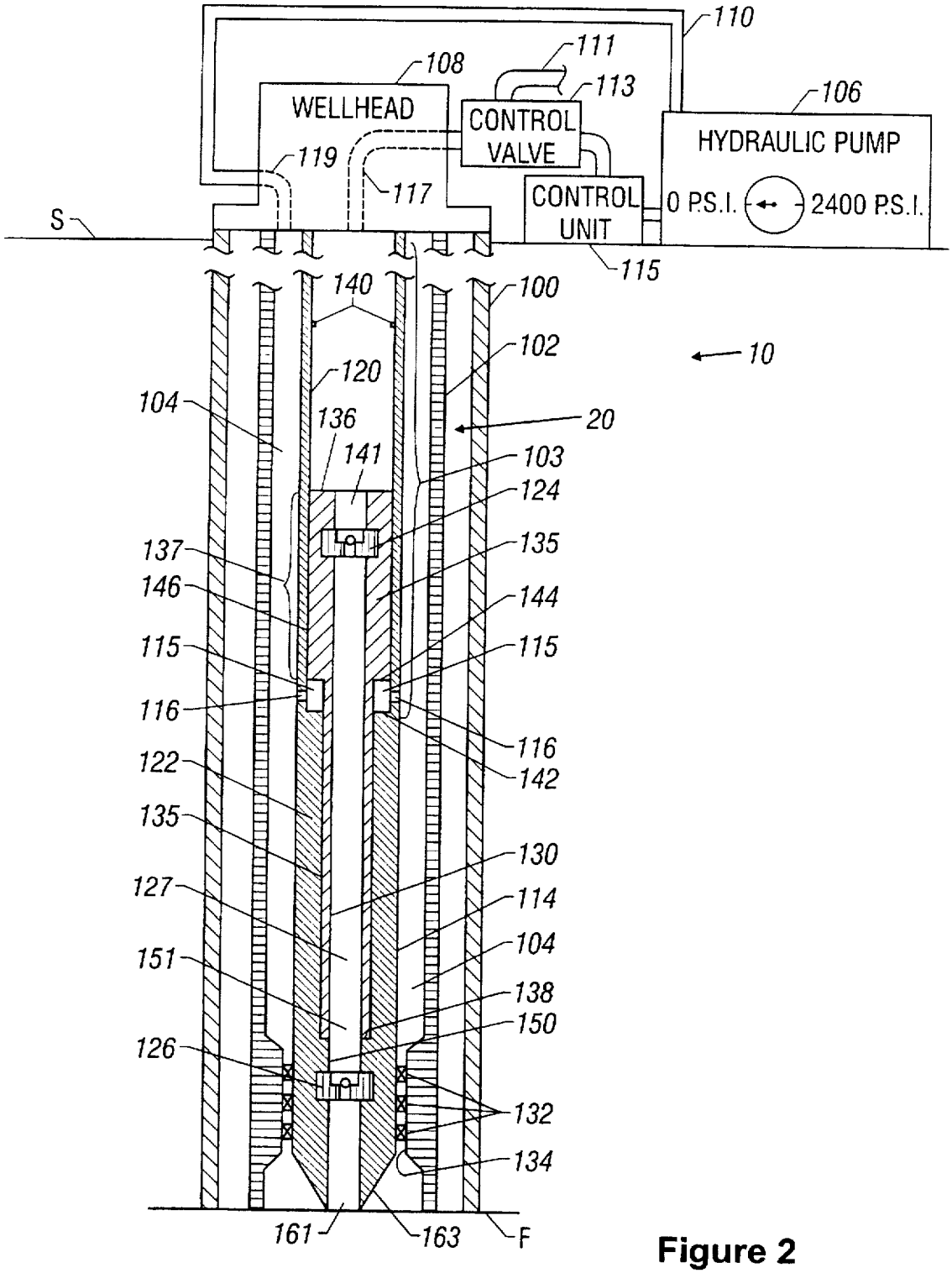
FIG. 2 is a cross-sectional side view of a subterranean well in accordance with an embodiment of the invention.
Figure 3:
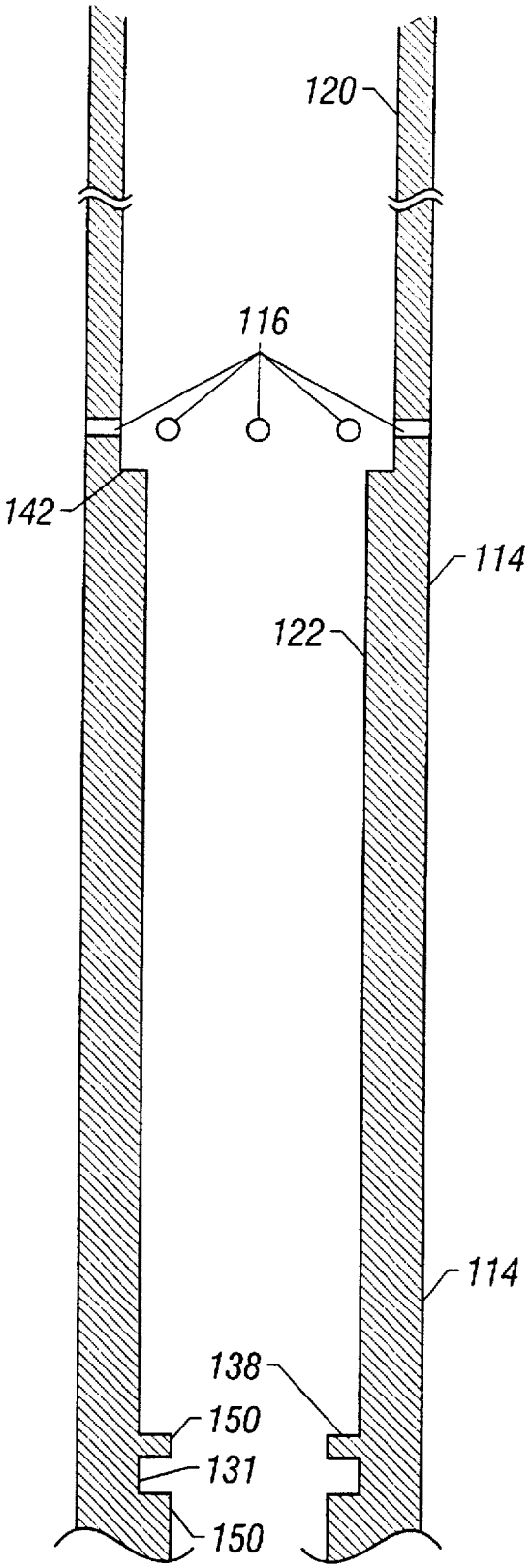
FIG. 3 is a cross-sectional side view of the barrel of FIG. 2.
Figure 4:
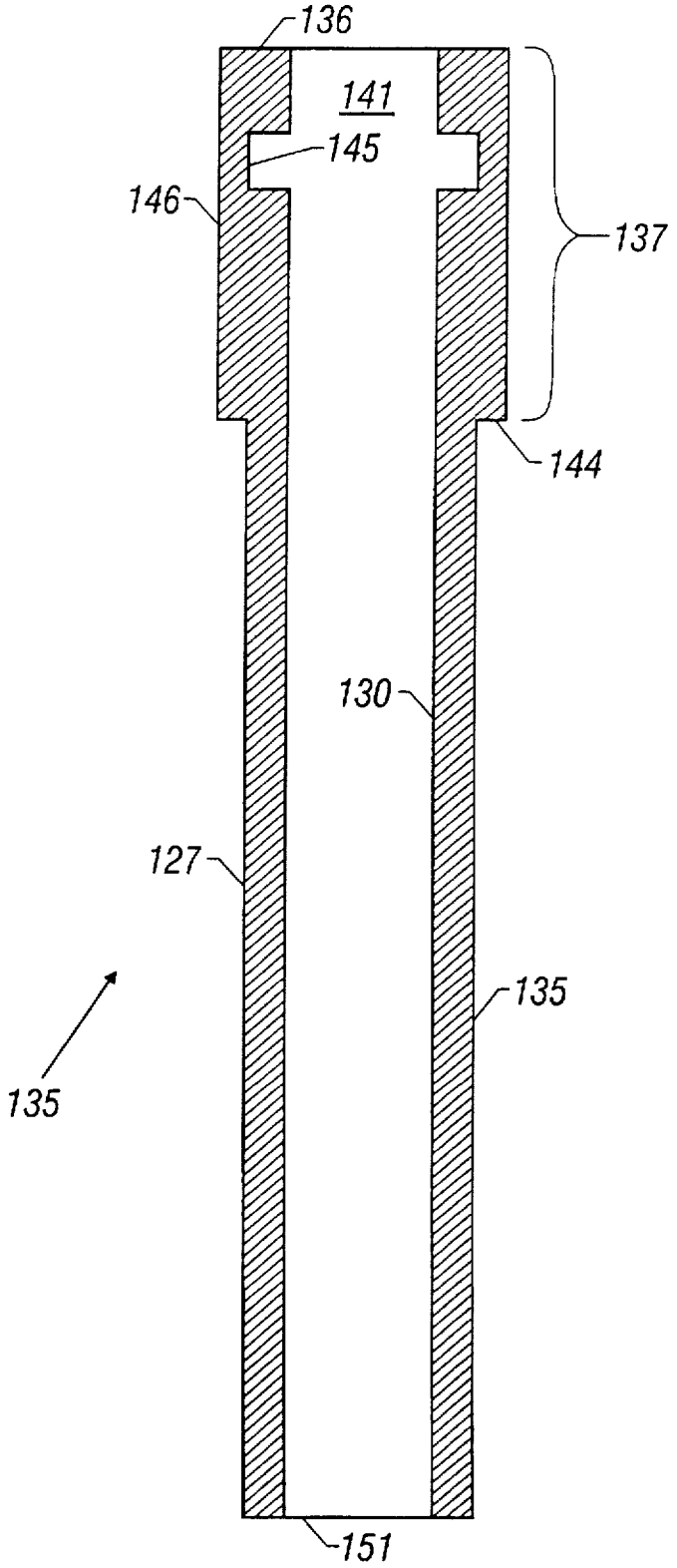
FIG. 4 is a cross-sectional side view of the plunger of FIG. 2.

As shown in FIGS. 2–4, a pump assembly 20 fits inside a well casing 100 of a subterranean well 10 having a small cross-sectional diameter. When a hydraulic pump 106 exerts pressure on hydraulic fluid in the pump assembly 20 and initiates a pump cycle, a reciprocating plunger 135 inside the pump assembly 20 displaces well fluid to a wellhead 108 where the displaced well fluid is removed. When the hydraulic pump 106 releases pressure on the hydraulic fluid, well fluid remaining in the pump assembly 20 resets the plunger 135 to a non-displaced position and allows additional well fluid to enter the pump assembly 20 which initiates another pump cycle.

The subterranean well 10 includes the well casing 100 that extends from a surface S of the earth toward a subterranean well fluid producing formation F. The wellhead 108 is secured to and seals the well casing 100 above the surface S. The wellhead 108 has a conduit 117 for delivering well fluids from the pump assembly 20. A conduit 119 of the wellhead 108 allows hydraulic fluid communication between the pump assembly 20 and the hydraulic pump 106 through a hydraulic line 110 connecting the conduit 119 and the hydraulic pump 106.

A control valve 113 connected to the distal end of the conduit 117 controls well fluid communication between the conduit 117 and a well fluid production pipe 111 that carries the well fluid away from the well 10. A control unit 115 is electrically coupled to and controls operation of both the control valve 113 and the hydraulic pump 106.

When the control unit 115 instructs the hydraulic pump 106 to exert pressure on the hydraulic fluid, the control unit 115 opens the control valve 113, allowing the displaced well fluid to flow through the wellhead 108 to the production pipe 111. The control unit 115 closes the control valve 113 when the control unit 115 instructs the hydraulic pump 106 to release pressure on the hydraulic fluid.

The pump assembly 20 is positioned and secured to the well casing by a tubing hanger (not shown). The pump assembly 20 includes a cylindrical outer tubing 102 coaxial with the casing 100 that extends from the surface S to the producing formation F. The outer tubing 102 can either be formed from one piece, otherwise known as "coiled tubing," or formed from threaded segments.

Near the formation F, a cylindrical tubing, or barrel 114, is secured to an end of a production tubing 121 that extends from the wellhead 108. The barrel 114 is coaxial with and forms an extension of the production tubing 121 to the formation F. The barrel 114 is circumscribed by and coaxial with the outer tubing 102. The production tubing 121 can either be formed from one piece, otherwise known as "coiled tubing," or formed from threaded segments.

The outer tubing 102 has an inner cylindrical surface 134, coaxial with the outer surface of the outer tubing 102, which forms a seating nipple for the barrel 114. Three annular seating bushings 132 form a seal between the outer surface of the barrel 114 and the seating nipple. An annular space 104 located above the seating nipples 132 and between the outer surface of the barrel 114 and the inner surface of the outer tubing 102 is filled with the hydraulic fluid. The hydraulic fluid has a lighter weight than the well fluid.

The barrel 114 has an inner cylindrical surface 120, coaxial with the barrel 114, that extends from the end of the production tubing 121 toward the well producing formation F. The surface 120 forms a side cylinder of a piston chamber 103. An annular stop ring 140 secured to the surface 120 limits the upward travel of the plunger 135.

The plunger 135 is formed from a tubular body and is located inside and coaxial with the barrel 114. The plunger 135 has one opening 151 near an end 153 proximate to the producing formation F for receiving the well fluid from the formation F when the hydraulic pump 106 releases pressure on the hydraulic fluid allowing the plunger 135 to travel in a downward direction toward the formation F. The received well fluid travels upward through the plunger 135, as the plunger 135 travels downward, to another opening 141 in an end 136 of the plunger 135 away from the formation F.

The plunger 135 has a ball and seat valve 124 that controls well fluid communication between the openings 151 and 141. The valve 124 is seated inside an annular notch 145 formed in an interior cylindrical surface 130 of the plunger 135. When the hydraulic pump 106 exerts pressure on the hydraulic fluid and the plunger 135 travels upward toward the wellhead 108, the valve 124 closes and inhibits well fluid communication between the openings 151 and 141. When the hydraulic pump 106 releases pressure on the hydraulic fluid and the column of well fluid above the plunger 135 forces the plunger back down, the valve 124 opens and allows well fluid communication between the openings 151 and 141.

The plunger 135 has an outer cylindrical surface 146 coaxial with the inner surface 120 that forms the side cylinder of a pump piston 137 adapted to move within the piston chamber 103 and displace the well fluid to the wellhead 108. The plunger 135 has an outer cylindrical surface 127 coaxial with and located below the surface 146 that extends to the end 153 of the plunger 135. The surface 127 guides the plunger 135. A shoulder 144 located between the surfaces 146 and 127 forms the bottom of the piston 137.

The barrel 114 has a cylindrical inner surface 122, smaller than the inner surface 120, that is located below and coaxial with the surface 120. The surface 122 functions with the surface 127 to guide the plunger 135. A shoulder 142 located between the surfaces 120 and 122 forms the bottom of the piston chamber 103.

The barrel 114 also has a cylindrical inner surface 150, smaller than the inner surface 122, that is located below and coaxial with the surface 122. A shoulder 138 is formed between the surfaces 150 and 122 and serves as a stop for limiting the downward travel of the plunger 135.

Orifices 116 radially extending through the barrel 114 near the bottom of the piston chamber 103 allow hydraulic fluid communication between the annular space 104 and a pump fluid space 115 which contacts the bottom of the piston 137. The limitation of downward movement of the plunger 135 by the shoulder 138 ensures the existence of the space 115 between the bottom of the piston chamber 103 and the bottom of the piston 137. When the hydraulic pump 106 exerts pressure on the hydraulic fluid, the hydraulic fluid enters the space 115 and moves the piston 137 upward.

The barrel 114 further includes a ball and seat valve 126 that controls well fluid communication between the formation F and the piston chamber 103. The valve 126 is seated in an annular notch 131 in the surface 150. Due to differential pressure, the valve 126 allows fluid communication between the formation F and the piston chamber 103 when the plunger 135 is moving in the upward direction. When the plunger 135 is moving in the downward direction, the valve 126 closes.

In order to facilitate the seating of the barrel 114 within the annular seating bushings 132, the barrel 114 has a conical outer surface 163 near an end 160 of the barrel 114 that is placed proximate to the formation F. The surface 163 extends from the inner surface 150 to the outer surface of the barrel 114.

Figure 5:
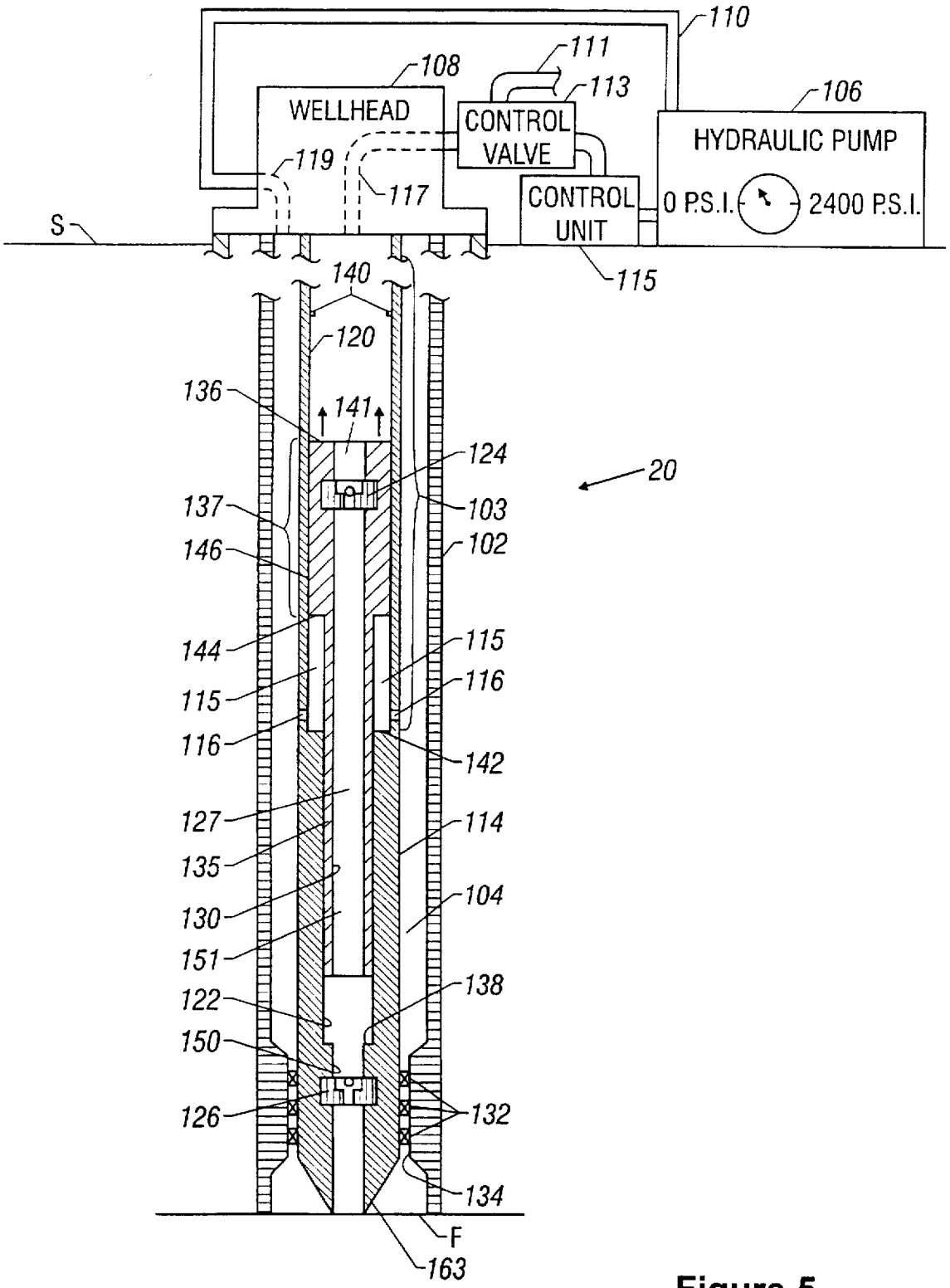
FIGS. 5–7 are cross-sectional side views of the well of FIG. 2 illustrating movement of the plunger.
Figure 6:
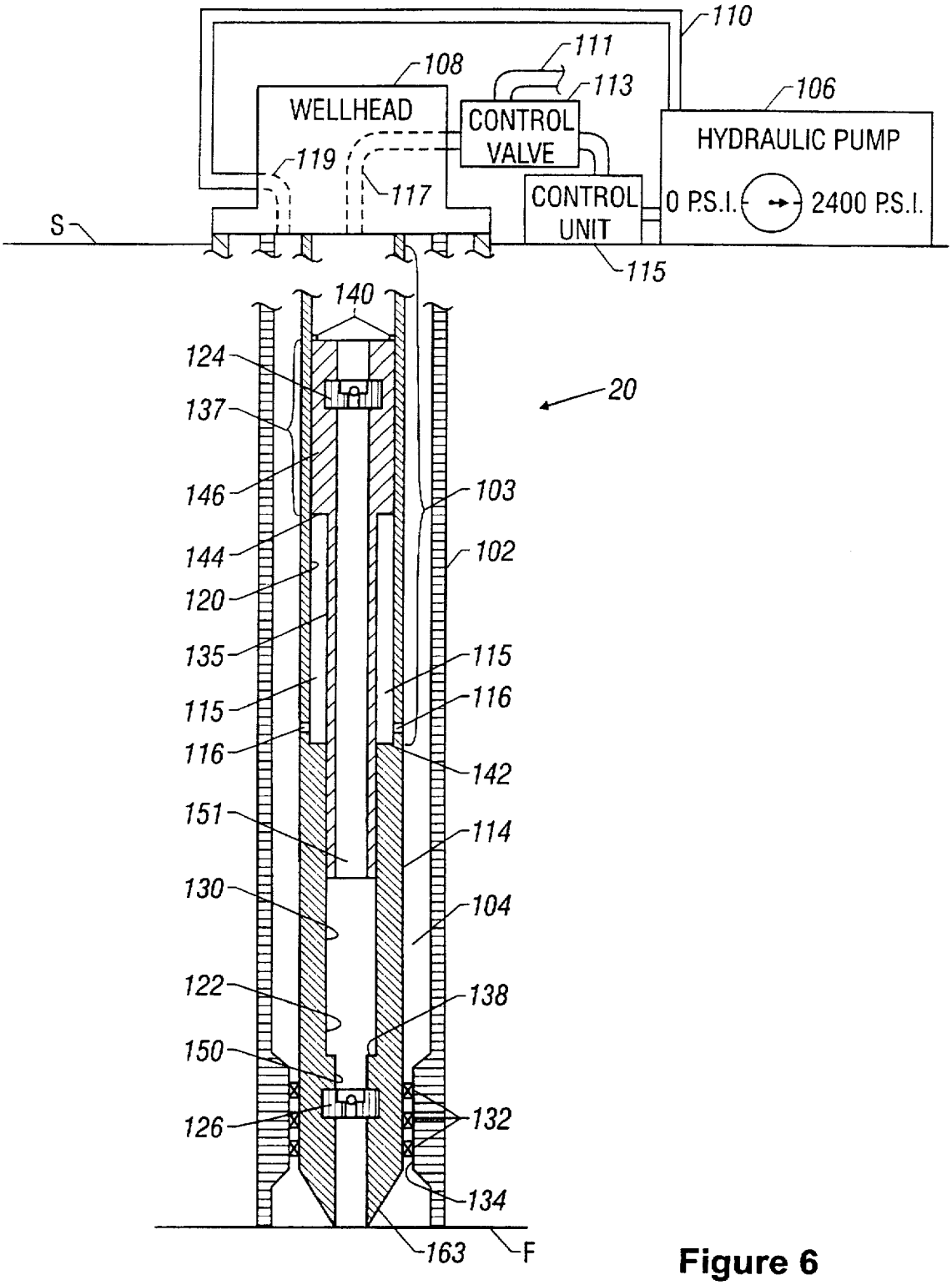
Figure 7:
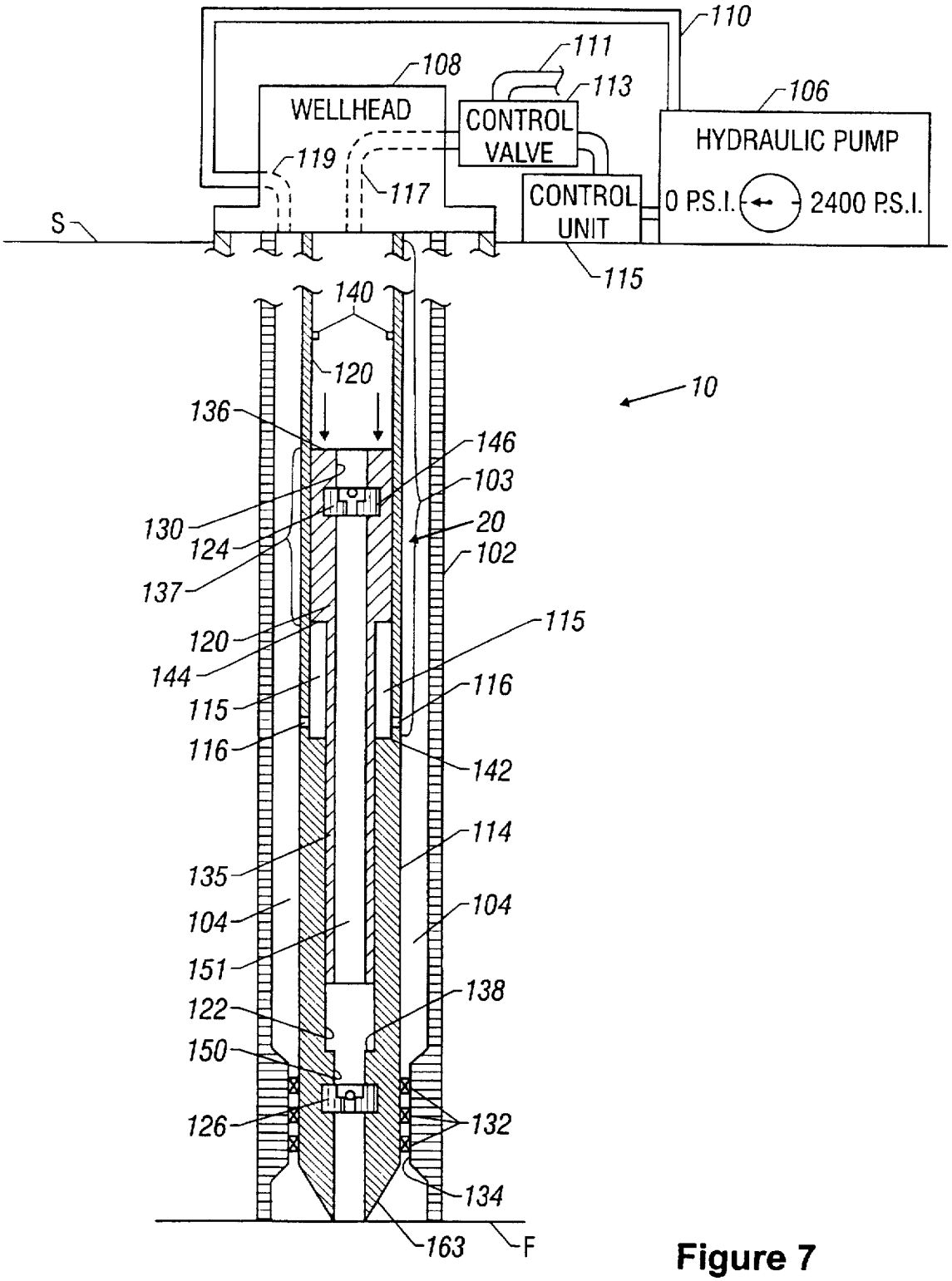

As shown in FIGS. 5–7, when the hydraulic pump 106 exerts pressure on the hydraulic fluid, the plunger 135 travels in an upward direction toward the wellhead 108. Because the plunger 135 is traveling upward, the valve 124 closes and the plunger 135 pushes the column of well fluid in the chamber 103 above the plunger 135 toward the wellhead 108. Because of the differential pressure, the valve 126 opens and allows well fluid to flow simultaneously through the valve 126 from the formation F.

When the plunger 135 abuts the stop ring 140, the pressure exerted by the hydraulic pump 106 reaches a predetermined maximum pressure. The predetermined maximum pressure is a function of the depth of the well 10, annular spaces and the weight of fluids in the well 10. When the predetermined maximum pressure is reached, the hydraulic pump 106 releases the pressure on the hydraulic fluid, and the plunger 135 is forced downward by the remaining column of well fluid above the plunger 135. When the plunger 135 stops moving, the valve 126 closes.

The control unit 115 waits a predetermined time for the plunger 135 to travel back to its reset position abutting the shoulder 138. When the plunger 135 is traveling in the downward direction, the valve 124 opens which allows additional well fluid to enter the piston chamber 103.

Figure 8:
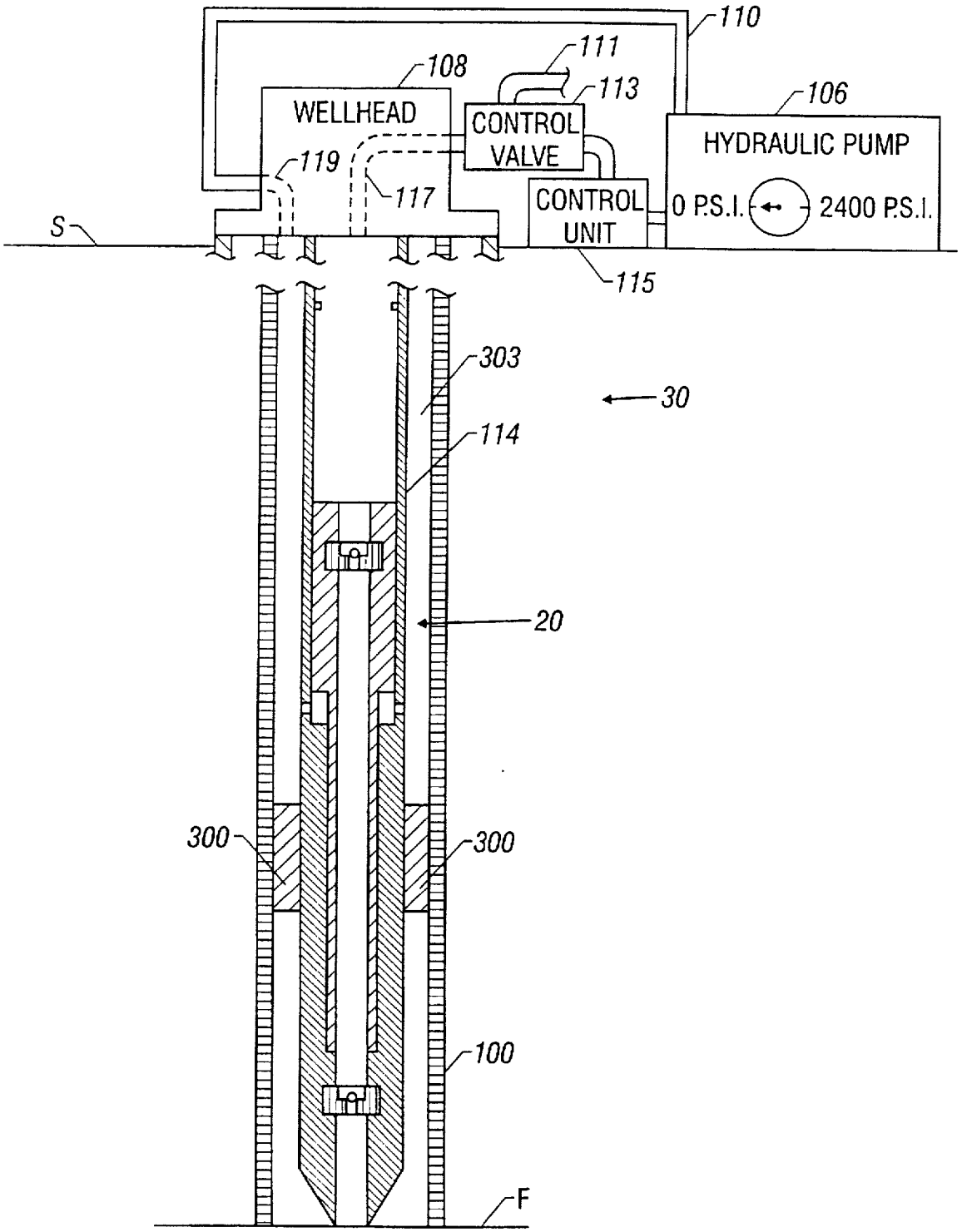
FIG. 8 is a cross-sectional side view of a subterranean well in accordance with an embodiment of the invention.

As shown in FIG. 8, the outer tubing 102 can be removed to further decrease the required cross-sectional diameter of the well casing 100. The inner surface of the well casing 100 and the outer surface of the barrel 114 create an annular space 303 for the hydraulic fluid. In this embodiment, a cylindrical packing element 300 coaxial with the barrel 114 secures the outer surface of the barrel 114 to the interior surface of the casing 100. The packing element 300 forms a seal and creates the annular space 303 above the packing element and between the exterior surface of the barrel 114 and the interior surface of the well casing 100.

In order to install the pump system 20 in an existing well having a down hole pump driven with sucker rods, a pulling unit is used to pull and lay all sucker rods from the existing well. Next, the down hole pump of the well is removed. The outer tubing 102 is then left inside the existing well. Next, the production tubing 121 and the barrel 114, which includes the plunger 135, is seated within the outer tubing 102. The annular space 104 is then filled with the hydraulic fluid, and the hydraulic pump 106 is then connected to the wellhead 108.

Preferred embodiments have been shown and described. However, the invention is not so limited. Rather, the scope of the invention is defined solely by the scope of the following claims.

What is claimed is:

1. A pump apparatus for use in a pump system of a well capable of exerting and releasing pressure on a pump fluid supplied to the pump apparatus, the pump apparatus comprising:

a tubular body having a pump fluid space for communicating with the pump fluid and a chamber for receiving well fluid from a producing formation and for furnishing the well fluid to a wellhead of the well, wherein the pump fluid and the well fluid remain separated inside the tubular body; and a plunger located inside the tubular body and in contact with the pump fluid in the pump fluid space and the well fluid in the chamber, the plunger configured to displace the well fluid from the chamber to the wellhead in response to the pump system exerting pressure on the pump fluid and to deliver the well fluid from the formation to the chamber in response to the pump system releasing pressure on the pump fluid.

2. The pump apparatus of claim 1, wherein the tubular body includes an orifice for establishing fluid communication between the pump fluid space and the pump fluid.

3. The pump apparatus of claim 1, wherein the plunger includes:

a tubular body for receiving the well fluid from the producing formation; and a valve located inside the tubular body of the plunger for allowing well fluid communication between the producing formation and the chamber in response to the pump system releasing pressure on the pump fluid and inhibiting well fluid communication between the producing formation and the chamber in response to the pump system exerting pressure on the pump fluid.

4. The pump apparatus of claim 1, wherein the weight of the well fluid in the chamber moves the plunger back to a non-displaced position allowing the well fluid to enter the chamber from the formation in response to the pump system releasing pressure on the pump fluid.

5. The pump apparatus of claim 1, further comprising a valve located inside the tubular body for allowing the well fluid to enter the tubular body from the producing formation when the pump system exerts pressure on the pump fluid and inhibiting the well fluid from leaving the tubular body and flowing back to the producing formation when the pump system releases pressure on the pump fluid.

6. The pump apparatus of claim 1, wherein the tubular body includes an orifice for establishing fluid communication between the pump fluid and the pump fluid space, the pump apparatus further comprising a tubular body, circumscribing the tubular body housing the device, for storing the pump fluid.

7. The pump apparatus of claim 1, wherein the weight of the plunger moves the plunger back to a non-displaced position allowing the well fluid to enter the chamber in response to the pump system releasing pressure on the pump fluid.

8. A pump system of a well comprising:

a pump reservoir for storing pump fluid;

a pump for exerting and releasing pressure on the pump fluid;

a control unit for controlling the pump, wherein the control unit instructs the pump to exert pressure on the pump fluid and subsequently instructs the pump to release pressure on the pump fluid after a predefined volume is displaced by the pump system;

a tubular body having a pump fluid space for communicating with the pump fluid and a chamber for receiving well fluid from a producing formation and for furnishing the well fluid to a wellhead of the well, wherein the pump fluid and the well fluid remain separated inside the tubular body; and a plunger located inside the tubular body and in contact with the pump fluid in the pump fluid space and the well fluid in the chamber, the plunger configured to displace the well fluid from the chamber to the wellhead in response to the pump system exerting pressure on the pump fluid and to deliver the well fluid from the formation to the chamber in response to the pump system releasing pressure on the pump fluid.

9. The pump system of claim 8, wherein the control unit monitors the pressure exerted on the pump fluid by the pump and the control unit determines the predefined volume is displaced when a predetermined pressure is exerted on the pump fluid by the pump system.

10. A method for pumping well fluid from a well by selectively applying or releasing pressure on pump fluid supplied to a pump apparatus having a chamber and a plunger, comprising the steps of:

releasing pressure on the pump fluid;

transferring well fluid from a producing formation of the well into the chamber in response to the step of releasing pressure on the pump fluid;

establishing contact between the plunger and the well fluid;

exerting pressure on the pump fluid; and using the plunger to displace the well fluid from the chamber to a wellhead of the well in response to the step of exerting pressure on the pump fluid, wherein the pump fluid and the pumped well fluid remain separated.

11. The method of claim 10, wherein the step of transferring includes moving the plunger using the weight of unpumped well fluid in the chamber.

12. The method of claim 10, wherein the step of transferring includes moving the plunger using the weight of the plunger.

13. The method of claim 10 further comprising the step of removing the well fluid before the pressure on the pump fluid is released.

14. A pump apparatus for use in a pump system of a well capable of exerting and releasing pressure on a pump fluid supplied to the pump apparatus, the pump apparatus comprising:

a tubular body having a pump fluid space and orifices for establishing fluid communication between the pump fluid and the pump fluid space and a chamber for receiving well fluid from a producing formation and for furnishing the well fluid to a wellhead of the well, wherein the pump fluid and the well fluid remain separated inside the tubular body; and a reciprocating tubular plunger located inside the tubular body and in contact with the pump fluid in the pump fluid space and the well fluid in the chamber, the tubular plunger having a valve which closes so that the plunger displaces the well fluid from the chamber to the wellhead in response to the pump system exerting pressure on the pump fluid and opens to deliver the well fluid from the formation to the chamber in response to the pump system releasing pressure on the pump fluid, wherein the plunger moves back to a non-displaced position under the weight of the well fluid when the pump system releases pressure on the pump fluid.

* * * * *